US005419126A

United States Patent [19]

Kiyooka

[11] Patent Number: 5,419,126

[45] Date of Patent: May 30, 1995

[54] EXHAUST SILENCER

[75] Inventor: Katsumi Kiyooka, Togane, Japan

[73] Assignee: Maruyama Mfg. Co. Inc, Tokyo, Japan

[21] Appl. No.: 995,897

[22] Filed: Dec. 23, 1992

[30] Foreign Application Priority Data

Dec. 25, 1991 [JP] Japan ..... 3-112038 U

[51] Int. Cl.[6] ..... F01N 3/28

[52] U.S. Cl. ..... 60/299; 60/302; 422/177

[58] Field of Search ..... 60/299, 302; 422/176, 422/177, 179

[56] References Cited

U.S. PATENT DOCUMENTS

| | | | |
|---|---|---|---|
| 3,166,895 | 1/1965 | Stayter | 60/299 |
| 3,380,810 | 4/1968 | Hamblin | 422/176 |
| 3,460,916 | 8/1969 | Aronsohn | 422/176 |
| 3,488,723 | 1/1970 | Veazie | 60/323 |
| 4,206,177 | 6/1980 | Otsubo | 422/176 |

FOREIGN PATENT DOCUMENTS

| | | | |
|---|---|---|---|
| 851933 | 9/1970 | Canada | 60/299 |
| 256325 | 2/1988 | European Pat. Off. | 60/299 |
| 2122111 | 10/1990 | Japan . | |
| 4113730 | 10/1992 | Japan . | |

*Primary Examiner*—Douglas Hart
*Attorney, Agent, or Firm*—Cushman, Darby & Cushman

[57] ABSTRACT

An exhaust silener for a compact 2-stroke cycle internal combustion engine has a housing, a sheet of sound absorbing material provided on the inner surface of the housing, and an oxidation catalyst means provided on the surface of the sound absorbing material. The catalyst serves to promote oxidation of unburnt components of lubricating oil in exhaust gases.

2 Claims, 2 Drawing Sheets

EXHAUST SILENCER

BACKGROUND OF THE INVENTION

1. Field of the Invention

The present invention relates to an exhaust silencer for internal combustion engines, in particular, 2-stroke cycle engines of, for example, a powered portable sprayers for spraying chemicals over, for example, a rice field or portable lawn mowers used in trimming lawn in a park or the like and, more particularly, to an exhaust silencer which is improved to prevent deposition of tar component of exhaust from the engine on sound absorbing material in the exhaust silencer.

2. Description of the Related Art

In general, exhaust gases from a compact 2-stroke cycle internal combustion engine are released into the atomsphere via an exhaust silencer which reduces the exhaust noise. In order to enhance the noise reduction, a sheet of sound absorbing material such as a felt-like material made of glass wool is laid on the inner surface of the exhaust silencer and retained in place by means of a rigid wire gauze overlaying the surface of the sound absorbing material.

Thus, in the conventional exhaust silencer, the sound absorbing material is directly exposed to the exhaust gases through the meshes of the rigid wire gauze.

Exhaust from a compact 2-stroke cycle engine contains unburnt components of lubricating oil which deposits on and permeates into the sound absorbing material in the form of a tar, resulting in significant reduction in the silencing effect of the sound absorbing material, as well as other detriments such as increase in the weight of the exhaust silencer and an damage to the same.

SUMMARY OF THE INVENTION

Accordingly, an object of the present invention is to provide an exhaust silencer in which sound absorbing material is not affected by tar and which can eliminate the abovedescribed disadvantages of the known art.

To this end, the present invention provides an exhaust silencer comprising a housing, a sheet of sound absorbing material provided on the inner surface of the housing and oxidation catalyst means covering the surface of the sound absorbing material.

In a specific form of the invention, the exhaust silencer further comprises a rigid wire gauze overlaying, the surface of the oxidation catalyst means for retaining the oxidation catalyst and the sound absorbing material on the inner surface of the housing.

During operation of an engine, unburnt components of lubricating oil emitted from the engine are mixed with the exhaust gases and the mixture is introduced into the exhaust silencer where the unburnt components in the mixture come into contact with the oxidation catalyst so as to be oxidized into oxide gases which are discharged through the exhaust silencer. The oxidation catalyst in the exhaust silencer also promotes oxidation of noxious unburnt exhaust components such as carbon monoxide (CO) and hydrocarbon (HC) so as to make the exhaust emissions innoxious before the emissions are released into the atmosphere.

In the specific form of the invention, the rigid wire gauze overlaying the oxidation catalyst serves to retain the catalyst means in place so that the sound absorbing material under the catalyst is also retained onto the inner wall of the exhaust silencer.

The above and other objects, features and advantages of the present invention will become clear form the following description of the preferred embodiments taken in conjunction with the accompanying drawings.

DESCRIPTION OF THE PREFERRED EMBODIMENTS

Figure 2:
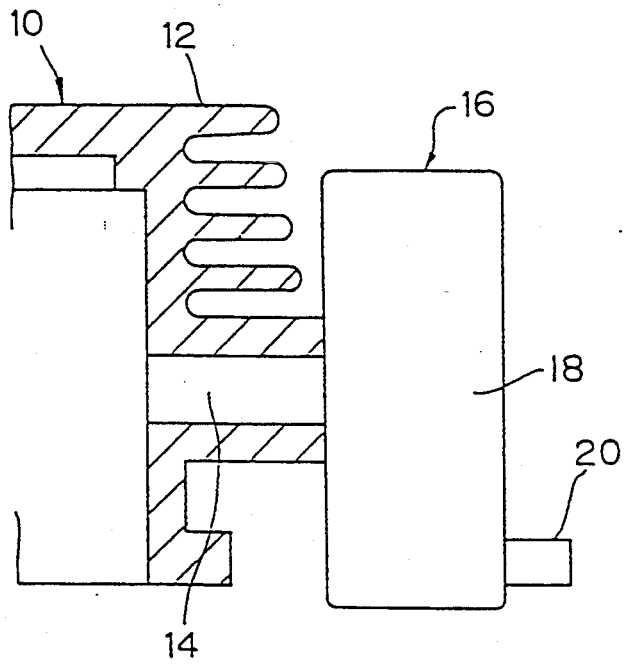
FIG. 2 is a schematic illustration a compact 2-stroke cycle engine to which the exhaust silencer is connected.

Referring to FIG. 2, an exhaust silencer 16 is used for a compact 2-stroke cycle engine 10 which is used as the power source of, for example, a portable powered sprayer for spraying powdered chemicals over a rice field or the like, or a portable lawn mower which is used for trimming lawn in a park or the like. Exhaust gases generated as a result of combustion in a cylinder 12 of the engine 10 is discharged through an exhaust port 14 which is formed in the side wall of the cylinder 12. The exhaust silencer 16 is connected to the exhaust port 14 so as to introduce exhaust gases thereinto. The exhaust gases are then expanded in the interior of the exhaust silencer and subsequently discharged to the exterior through an exhaust outlet 20.

Figure 1:
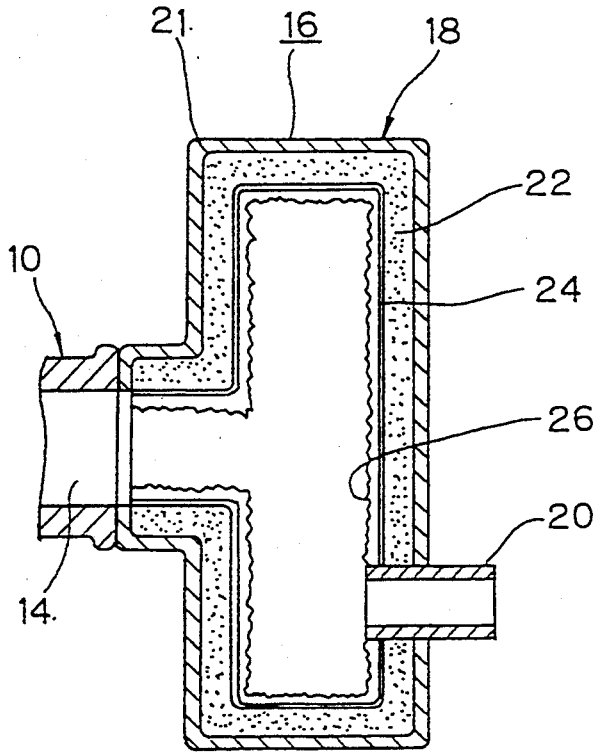
FIG. 1 is a vertical sectional view of an exhaust silencer which is a preferred embodiment of the present invention.

FIG. 1 is a vertical sectional, view of the exhaust silencer 16. The exhaust silencer 16 has its main body 18 defining a housing 21 which is lined on its inner surface with a sheet sound absorbing material 22 such as a felt-like material made of glass wool. An oxidation catalyst means 24 comprises a base member made of, for example, woven cloth of twisted yarns of a multiplicity of ceramic fibers such as silica or alumina, a thin carrier layer of silica or alumina which is formed on the ceramic base member and a small amount of catalytic metal such as platinum or palladium dispersed in the carrier layer. The oxidation catalyst means 24 is arranged so as to cover the surface of the sound absorbing material 22. A metallic wire gauze 26 which may be of stainless steel overlays the surface of the oxidation catalyst means 24 so as to retain the catalyst means 24 and the sound absorbing material 22 onto the inner surface of the housing 21.

In operation of the engine, unburnt components of lubricating oil emmitted from the engine 10 is mixed with the exhaust gases and the mixture is introduced through the exhaust port 14 into the exhaust silencer 16 where the unburnt components then come into contact with the oxidation catalyst 24 so that they are oxidized into oxide gases which are then discharged through the exhaust outlet 20 into the atmosphere. The oxidation catalyst 24 in the exhaust silencer 16 also promotes oxidation of noxious unburnt exhaust components such as carbon monoxide (CO) and hydrocarbon (HC) emitted from the engine 10 so as to clean the exhaust emisions prior to release of the emissions into the atmosphere.

As will be understood from the foregoing description, according to the present invention, unburnt components of lubricating oil introduced from the engine into the exhaust silencer contact the oxidation catalyst means covering the surface of the sound absorbing material so that oxidation of such unburnt substance is pormoted to convert the components into oxide gases. Thus, the oxide gases are discharged into the air, without forming tar which heretofore has caused serious problems due to deposition on and permeation into the sound absorbing material. The oxidation catalyst means also is effective in oxidizing unburnt components of the fuel contained in exhaust gases, thereby cleaning exhaust emissions before the emissions are released to the air.

The rigid wire gauze is used for the purpose of retaining the sound absorbing material as well as the oxidation catalyst means on the inner surface of the silencer housing. It is therefore possible to omit any specific fixing means for securing the oxidation catalyst means, thus contributing to simplification of construction.

What is claimed is:

1. An exhaust silencer, comprising:

a housing having an inner surface;

a sound absorbing material disposed on said inner surface of said housing;

oxidation catalyst means for oxidizing unburnt oil components, said oxidation catalyst means being disposed upon said sound absorbing material; and a rigid wire gauze disposed upon said oxidation catalyst means, whereby said oxidation catalyst means is retained upon said sound absorbing material by being disposed between said rigid wire gauze and said sound absorbing material.

2. An exhaust silencer according to claim 1 wherein said sound absorbing material includes a sheet of material made of glass wool.

* * * * *